US007405518B2

(12) United States Patent
Kim

(10) Patent No.: US 7,405,518 B2
(45) Date of Patent: Jul. 29, 2008

(54) MGO PELLET FOR PROTECTIVE LAYER OF PLASMA DISPLAY PANEL, AND PLASMA DISPLAY PANEL USING THE SAME

(75) Inventor: Ki-Dong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 472 days.

(21) Appl. No.: 10/963,860

(22) Filed: Oct. 12, 2004

(65) Prior Publication Data

US 2005/0082982 A1 Apr. 21, 2005

(30) Foreign Application Priority Data

Oct. 21, 2003 (KR) ..... 10-2003-0073531

(51) Int. Cl.
*H01J 17/49* (2006.01)

(52) U.S. Cl. ..... 313/587; 313/586

(58) Field of Classification Search ..... 313/582–587
See application file for complete search history.

(56) References Cited

U.S. PATENT DOCUMENTS

2004/0053081 A1* 3/2004 Sakurai et al. ..... 428/704
2004/0056594 A1* 3/2004 Kotera et al. ..... 313/582
2004/0075388 A1* 4/2004 Miyashita et al. ..... 313/586

FOREIGN PATENT DOCUMENTS

| | | |
|---|---|---|
| JP | 11-054045 | 2/1999 |
| JP | 2001-110321 | 4/2001 |
| JP | 2001-220669 | 8/2001 |
| JP | 2002-033054 | 1/2002 |
| JP | 2002-110050 | 4/2002 |
| JP | 2003-317631 | 11/2003 |
| KR | 1998-079548 | 11/1998 |
| KR | 2002-0025672 | 4/2002 |
| KR | 2003-0024923 | 3/2003 |

OTHER PUBLICATIONS

Patent Abstracts fo Japan, Publication No. 2002-110050, dated Apr. 12, 2002, in the name of Hiroshi Kajiyama et al.
Korean Patent Abstracts for Publication No. 1020020025672; Date of publication of application Yasushi Ihara et al.

(Continued)

*Primary Examiner*—Karabi Guharay
*Assistant Examiner*—Bumsuk Won
(74) *Attorney, Agent, or Firm*—Christie, Parker & Hale, LLP

(57) ABSTRACT

MgO pellets are provided for use as a protective layer for a plasma display panel providing improved physical properties. The plasma display panel includes first and second substrates facing each other. A plurality of first and second electrodes are internally formed on the first and the second substrates. Dielectric layers cover the first and the second electrodes and a MgO protective layer covers one of the dielectric layer. The MgO protective layer has 400 columnar crystals per $\mu m^2$.

4 Claims, 4 Drawing Sheets

OTHER PUBLICATIONS

Korean IPO Abstract; Korean Patent Publication No. 1019980079548A; Korean Patent Laid-Open date: Nov. 25, 1998, in the name of Takeyoshi Takenouchi et al.

Patent Abstract of Japan, Publication No. 2001-110321, Published on Apr. 20, 2001, in the name of Hidaka, et al.

Patent Abstract of Japan, Publication No. 2001-220669, Published on Aug. 14, 2001, in the name of Kawaguchi, et al.

Patent Abstracts of Japan, Publication No. 11-054045, Published on Feb. 26, 1999 in the name of Hidaka.

Patent Abstracts of Japan, Publication No. 2002-033054, published on Jan. 31, 2002 in the name of Kodera et al.

Patent Abstracts of Japan, Publication No. 2003-317631, published on Nov. 7, 2003 in the name of Hasegawa et al.

* cited by examiner

PRIOR ART

MGO PELLET FOR PROTECTIVE LAYER OF PLASMA DISPLAY PANEL, AND PLASMA DISPLAY PANEL USING THE SAME

CROSS-REFERENCE

The present application is based on and claims priority to Korean Patent Application No. 10-2003-0073531 filed in the Korean Intellectual Property Office on Oct. 21, 2003, the entire contents of which are incorporated herein by reference.

FIELD OF THE INVENTION

The present invention relates to MgO pellets used for providing a protective layer for a plasma display panel, and also to a plasma display panel using such pellets whereby the discharge delay time is minimized.

BACKGROUND OF THE INVENTION

Generally, a plasma display panel (referred to hereinafter simply as a "PDP") is a display device which displays images with phosphors excited by the plasma discharge. When voltages are applied to the electrodes arranged within the discharge space of the PDP, a plasma discharge is generated between the electrodes and generates ultraviolet rays. The ultraviolet rays excite the phosphors with a predetermined pattern, thereby displaying the desired images.

A PDP is generally classified as an AC-type, a DC-type or a hybrid-type. FIG. 4 is an exploded perspective view of a discharge cell for a common AC-type PDP. As shown in FIG. 4, the PDP 100 includes a bottom substrate 111, a plurality of address electrodes 115 formed on the bottom substrate 111, a dielectric layer 119 formed on the bottom substrate 111 over the address electrodes 115, a plurality of barrier ribs 123 formed on the dielectric layer 119 and phosphor layers 125 formed between the barrier ribs 123. The barrier ribs maintain the discharge distance and prevent cross talk between the cells.

A plurality of discharge sustain electrodes 117 are formed on the lower surface of a top substrate 113 facing the bottom substrate 111 and spaced apart from the address electrodes 115 formed on the bottom substrate 111. The address electrodes are oriented perpendicular to the sustain electrodes. A dielectric layer 121 and a protective layer 127 sequentially cover the discharge sustain electrodes 117 on the side opposite the top substrate. While other materials may be used, the protective layer 127 is often formed of MgO.

The MgO protective layer is a transparent thin film, which reduces the effect of the ion collision caused by the discharge gas during operation, thereby protecting the dielectric layer. The MgO layer also emits secondary electrons so that the discharge voltage is lowered. The MgO protective layer is generally formed on the dielectric layer to a thickness of 3000-7000 Å. The MgO protective layer is generally formed using a sputtering method, electron beam deposition, ion beam assisted deposition (IBAD), chemical vapor deposition (CVD), or a sol-gel method. Recently, an ion plating method has been developed and has been used to form a MgO protective layer.

With regard to the electron beam deposition method, electron beams accelerated by electromagnetic fields collide against the MgO deposition material in order to heat and vaporize it, thereby forming a MgO protective layer. Although the sputtering method is preferred over the electron beam deposition method because the resulting protective layer is more densely formed with favorable crystalline alignment, the production costs are unfavorably high For the sol-gel method, the MgO protective layer is formed from a liquid phase.

As an alternative to these various methods for forming a MgO protective layer, an ion plating method has been recently developed. In the ion plating method, vaporized particles are ionized and form a target layer. Although the ion plating method is similar to the sputtering method with respect to the adhesion and crystallinity of the MgO protective layer, there is an advantage in that it is capable of rather high speed deposition at 8 nm/s.

According to such a processes, single crystal of MgO or sintered MgO is used. However, it is difficult to control the suitable amount of a specific dopant due to the difference of the solid solution limit in cooling process to manufacture a single crystal of MgO. Namely, a specific dopant for controlling the quality of MgO layer is precipitated without being solved in a single crystal of MgO during cooling process. For this reason, the MgO protective layer is generally formed by the ion plating method using a sintered MgO combined with a suitable amount of an appropriate dopant. Pellet-shaped materials may be used to deposit the MgO protective layer. The dissolution speed of the MgO generally depends upon the size and the shape of the pellets. Therefore, various attempts have been made to optimize the size and the shape of the MgO pellets.

SUMMARY OF THE INVENTION

In one embodiment of the present invention, MgO pellets with improved physical properties are provided and used for forming a MgO protective layer for a PDP. The use of such MgO pellets in forming a PDP protective layer enhances the discharge quality of the PDP.

In one embodiment of the present invention, the PDP includes first and second substrates facing each other. A plurality of first and second electrodes are internally formed on the first and the second substrates, respectively with the first and the second electrodes running in directions perpendicular to one another. Dielectric layers cover the first and the second electrodes. A MgO protective layer covers at least one of the dielectric layers. In one embodiment of the invention, the density of columnar crystals in the MgO protective layer is 400 columnar crystals or less per $\mu m^2$.

In one embodiment, the MgO protective layer preferably has a refractive index of 1.45-1.74.

In another embodiment, the protective layer has (111) planes and (110) planes in a mixed manner.

According to the invention, the MgO pellets may be used to form a protective layer with a bulk density of 2.80-2.95 $g/cm^3$.

In yet another embodiment, the MgO pellets preferably have a mean crystal grain size of 30-70 μm.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION

The present invention will be described more fully hereinafter with reference to the accompanying drawings, in which various embodiments of the invention are shown.

Figure 1:
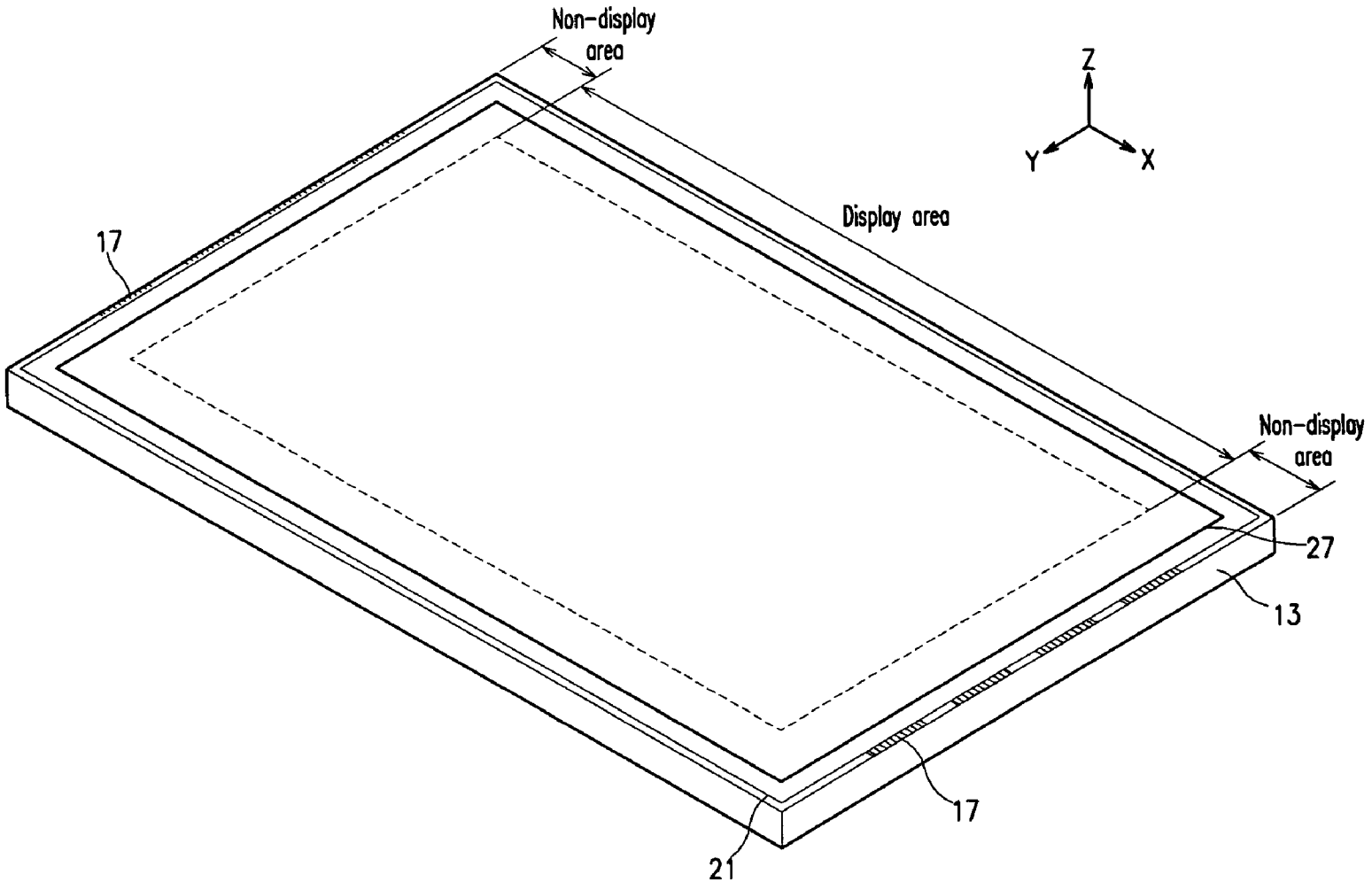
FIG. 1 is a perspective view of an upper panel of a PDP according to an embodiment of the present invention.

FIG. 1 is a perspective view of an upper panel of a PDP according to an embodiment of the present invention.

Figure 4:
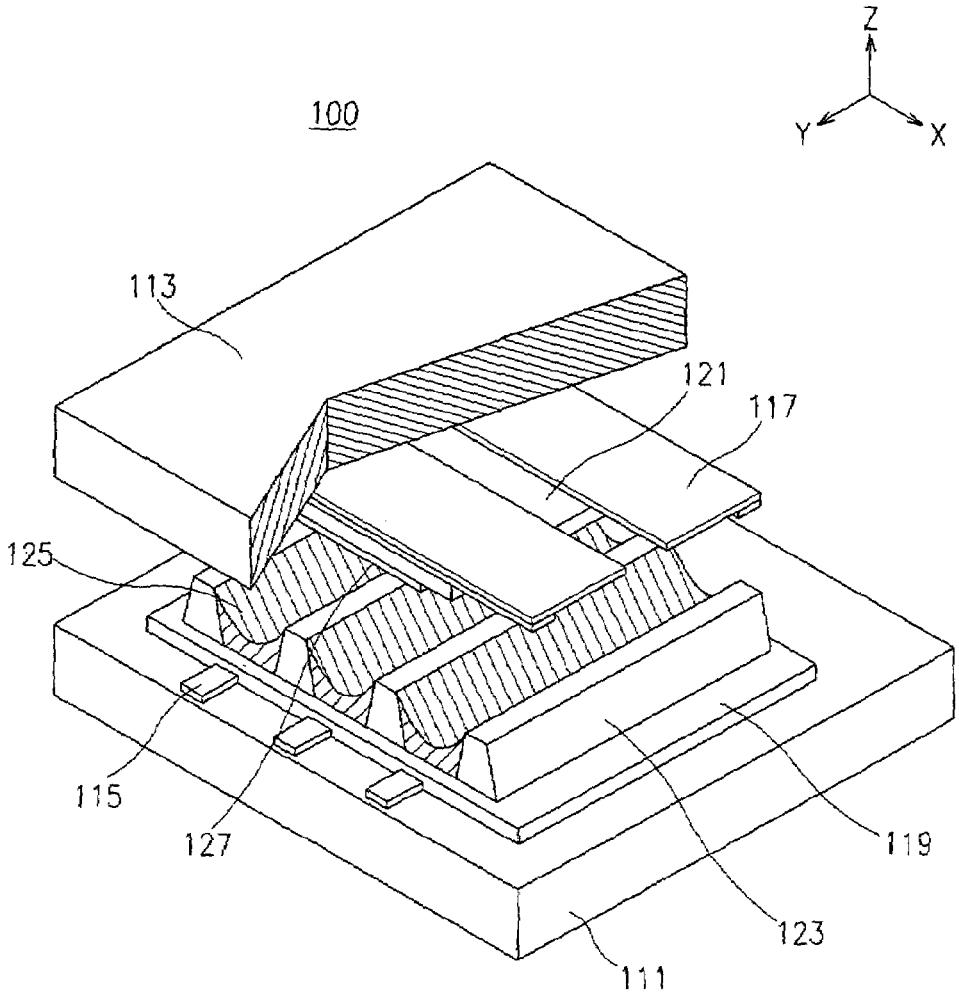
FIG. 4 is an exploded perspective view of a discharge cell of a PDP according to the prior art.

As shown in FIG. 1, the upper panel of a PDP according to an embodiment of the present invention is shown. A plurality of first electrodes 17, a dielectric layer 21 and a protective layer 27 are sequentially formed on a top substrate 13. The lower panel of the PDP is manufactured according to the prior art as set forth in FIG. 4. For clarity of illustrating the invention, the upper panel of FIG. 1 has been flipped 180 degrees compared to the PDP of FIG. 4. A plurality of second electrodes 115 are formed on a bottom substrate 111 facing the top substrate 13 and are positioned to run in a direction perpendicular to the first electrodes 17. A dielectric layer 119 covers the second electrodes. Barrier ribs 123 are formed on the dielectric layer, and phosphor layers 125 are formed between the barrier ribs.

Frits are coated on the peripheries of the upper and the lower panel, which are then sealed to each other. A discharge gas such as Ne or Xe is injected between the panels, thereby completing the PDP.

With regard to the PDP according to one embodiment of the present invention, upon application of driving voltages to the electrodes, an address discharge is made between the electrodes, thereby forming a wall charge at the dielectric layer. With the discharge cells selected by the address discharge, a sustain discharge is made between a pair of electrodes formed on the upper panel by the current signals alternately fed thereto. Consequently, the discharge gas filled within the discharge space forming the discharge cells is excited and shifted, thereby generating ultraviolet rays. Phosphors are excited by the ultraviolet rays to thereby generate visible rays, and display the desired images.

As shown in FIG. 1, in the PDP according to this embodiment of the present invention, a plurality of electrodes cross each other within the protective layer to thereby form pixels, which form a display area together surrounded by a non-display area. The plurality of electrodes 17 formed on the substrate 13 are illustrated to the left and the right of the dielectric layer 21 at their terminal portions where they are connected to a flexible printed circuit board (FPC, not shown).

With the PDP according to an embodiment of the present invention, the MgO protective layer 27 is formed by depositing MgO pellets in a MgO deposition chamber. The MgO pellets for the protective layer of the PDP according to the embodiment of the present invention are made by the following method.

First, a MgO powder with a purity of 90.0-92.0% is prepared, and a doping material is added thereto to form $Mg(OH)_2$. Sufficient doping material is added to improve the purity thereof to 99.0%.

The $Mg(OH)_2$ has a moisture content of 50.0%, and is dried in an oven with hot air to remove the water. After drying, the $Mg(OH)_2$ is electrically fused in a bell type low temperature sintering furnace at 2800° C. for 60 hours, thereby calcinating it. In this way, the water of crystallization is removed from the $Mg(OH)_2$ to thereby obtain a MgO powder. The electrically fused MgO powder is then cooled and solidified again.

The solidified MgO powders are broken using a breaker, and are mixed with an adjunct of a solvent and an additive to form a slurry. The mixing is made using a wet mill technique, and 99.5% or more of an anhydrous solvent and Aldrich reagent are used as the additives. Zirconia balls and urethane ports are used in the wet milling.

The MgO slurry is dried by the spray drying method using an explosion proof spray dryer to form MgO granules. In the agglomeration process, MgO powder with a mean particle size of 3-5 μm is spherically agglomerated by 80 μm.

Then, the MgO granules are press-formed using a rotary press. The press-formed MgO granules are sintered and crystallized in a high temperature sintering furnace at 1700° C. When the sintering is made at that temperature, the surfaces of the MgO granules are molten and are adhered to those of other MgO granules so that the density of the MgO granules is increased and the pores thereof are reduced, thereby forming MgO pellets with a dense structure.

The bulk density of the MgO pellets is preferably from 2.80 to 2.95g/cm$^3$. The bulk density of the MgO pellets is obtained through the mathematical formula 1. A sample of the MgO pellets is dried at 100° C. for 24 hours or more, and is calculated by kerosene immersion.

$$\text{Bulk density (g/cm}^3\text{)} = k \times \text{mass of dried sample (g)} / (\text{mass of moisture-contained sample (g)} - \text{mass of moisture content (g)}) \quad \text{Formula 1}$$

where k is 0.796 g/cm$^3$, the specific gravity of kerosene.

The bulk density of MgO pellets for the protective layer of the PDP according to the embodiment of the present invention can be controlled through the steps of drying a MgO slurry mixed by the spray drying method to form MgO granules, press-forming the MgO granules, and sintering the MgO granules in a high temperature sintering furnace.

Figure 2:
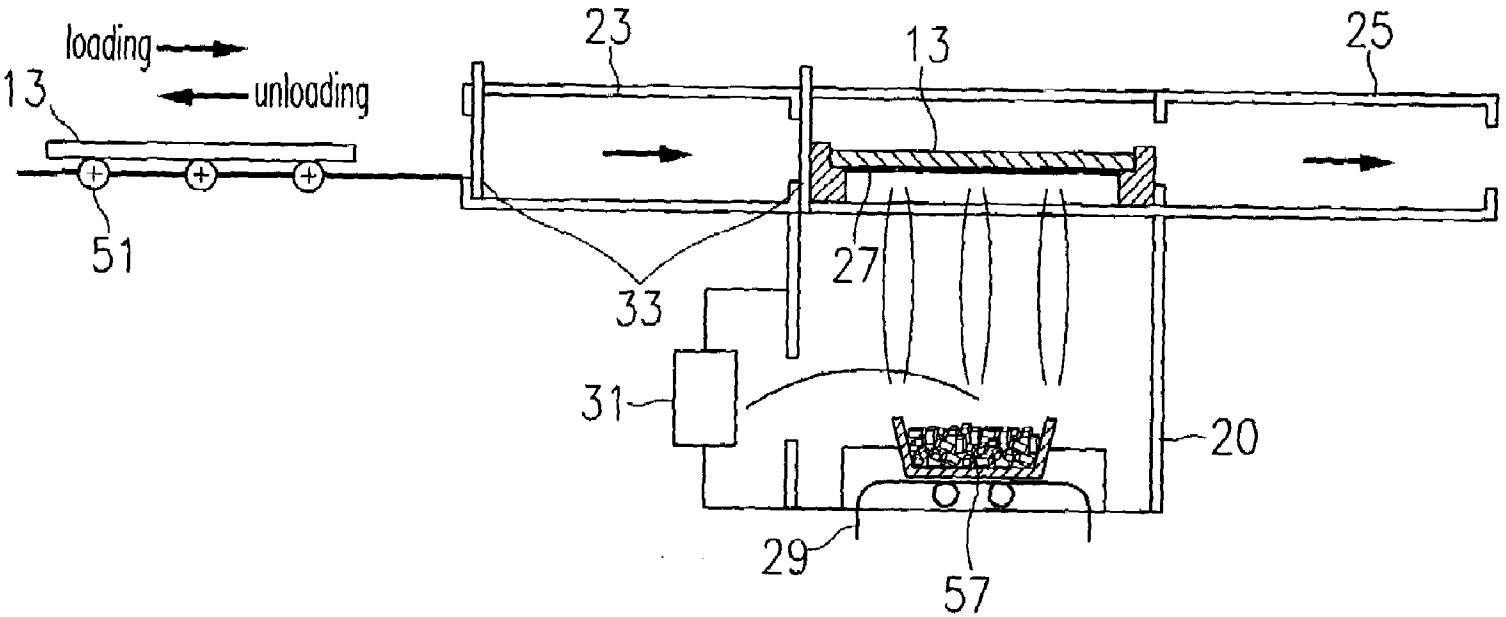
FIG. 2 schematically illustrates the process of depositing a MgO layer according to an embodiment of the present invention.

FIG. 2 schematically illustrates the process of forming a MgO protective layer using MgO pellets. The electron beam deposition method is introduced here to form the MgO protective layer on a substrate sequentially overlaid with electrodes and a dielectric layer.

In the electron beam deposition method, electron beams are accelerated by electromagnetic fields and collide against the deposition material to thereby heat and vaporize it, and form a protective layer. In this case, the energies of the electron beams are concentrated on the material surface, thereby enabling the high speed deposition and the high purity deposition. FIG. 2 illustrates an exemplary process of forming the protective layer, and the process of forming the protective layer is not limited to the electron beam deposition method.

In the process of forming the MgO protective layer 27 shown in FIG. 2, the substrate 13 is transferred from the left to the right by rollers 51, and loaded into an inlet port 23 of the deposition chamber 20. After the MgO protective layer 27 is deposited on the substrate 13, it is discharged through the outlet port 25 of the deposition chamber 20. If there is something wrong with the substrate 13, it is possible to unload the substrate 13 from the inlet port of the deposition chamber 23. Since the deposition chamber 20 should be in a vacuum state, a vacuum pump (not shown) is attached thereto to exhaust the interior gas continuously. The deposition chamber 20 is isolated from the outside using shutters 33. An electron gun 31 is operated to form the electromagnetic fields. The ions emitted from the electron gun 31 collide against the MgO pellets 57 placed at the bottom of the deposition chamber 20 to thereby deposit a MgO layer on the substrate 13 placed at the top of the deposition chamber 20. The MgO pellets 57 have a tendency to overheat due to the ion collisions, and therefore, the MgO protective layer 27 is formed while cooling the MgO pellets 57 with a cooler 29.

In the process of depositing a MgO protective layer 27, if the bulk density of the MgO pellets is less than 2.80 g/cm$^3$, a numbers of pores are present in the MgO pellets making it impossible to manufacture a MgO protective layer having a dense crystal structure. In contrast, if the bulk density of the MgO pellets exceeds 2.95 g/cm$^3$, the MgO pellets are so densely formed that the decomposition speed of MgO is lowered, thereby deceasing the decomposition speed when forming the MgO protective layer. Although the MgO protective layer is commonly deposited at 60-110 Å/s, if the bulk density of the MgO pellets is controlled to be in the range of 2.80-2.95 g/cm$^3$, its deposition speed can be increased to 130 Å/s. The relatively low bulk density can be controlled by reducing the splash phenomenon due to the thermal shock such that the substrate is not damaged during the deposition. In this case, the mean crystal grain size of the MgO pellets is preferably from 30 to 70 μm. Therefore, the MgO protective layer can be deposited onto the PDP substrate while reducing the splash phenomena.

Figure 3:
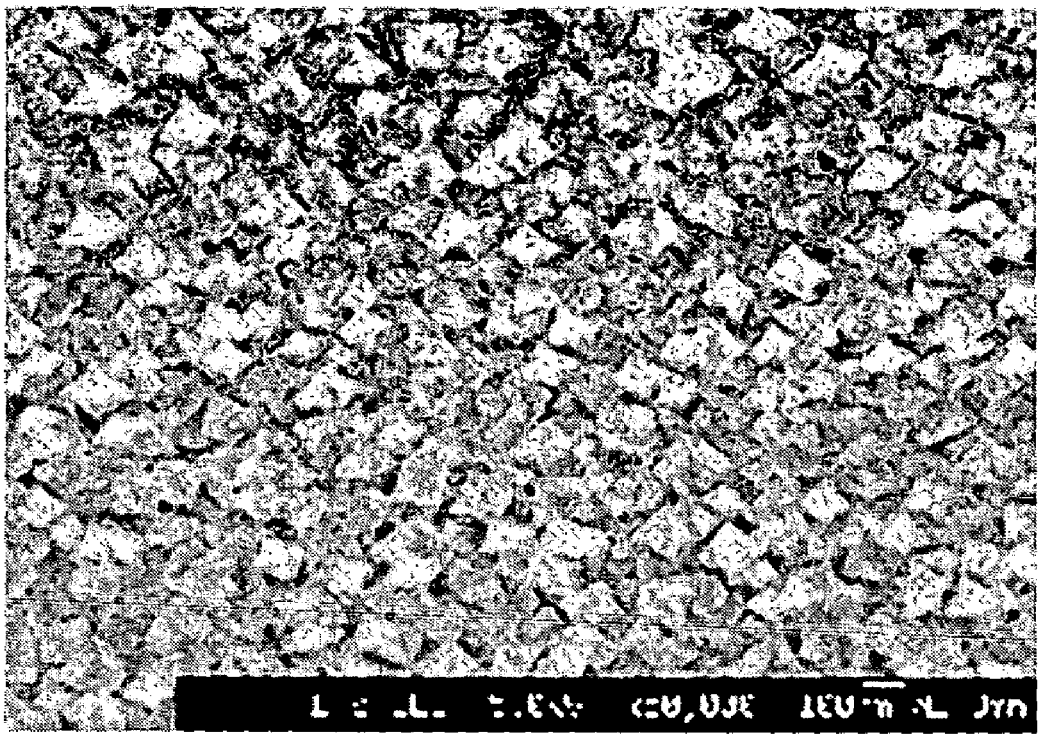
FIG. 3 is a SEM photograph illustrating the crystal planes of a MgO protective layer according to an embodiment of the present invention.

FIG. 3 is a scanning electron microscope (SEM) photograph of a MgO protective layer according to an embodiment of the present invention. The MgO protective layer shown in FIG. 3 is formed while maintaining the partial pressure ratio of oxygen to hydrogen at about 6:1. As known from the SEM photograph of FIG. 3, the triangle-shaped crystal planes and the rectangle-shaped crystal planes are uniformly mixed in the MgO protective layer according to the embodiment of the present invention. The triangle-shaped crystal plane is a plane (111), and the rectangle-shaped crystal plane is a plane (110). By controlling the partial pressure of oxygen and hydrogen when depositing the MgO protective layer on the substrate of the PDP, the number of columnar crystals is varied. In order to evaluate the influence of the number of columnar crystals in the MgO protective layer on the discharge quality of the PDP, several experiments were made as set forth below.

EXPERIMENTAL EXAMPLES

In order to evaluate the features of the MgO protective layer as a function of the columnar crystal density (measured as the number of columnar crystals per μm$^2$), the discharge delay times as a function of the respective numbers of columnar crystals in a 1 μm$^2$ area of a MgO protective layer were measured. The time required for applying the driving voltage to the PDP through scanning electrodes is referred to as the scanning time. Although the discharge occurs during the scanning time, the discharge does not instantly occur as soon as the driving voltage is applied so that the discharge is delayed. This is referred to as a discharge delay time. The discharge delay time is divided into a formation delay time and a statistical delay time. The MgO protective layer is intimately related to the discharge of secondary electrons. Therefore, in the Experimental Examples of the present invention, the discharge delay time according to the number of columnar crystals per μm$^2$ was measured so that the proper range for the density of columnar crystals could be derived therefrom. It is to be noted that the following Experimental Examples merely illustrate specific embodiments of the present invention, and the scope of the present invention is not limited thereto.

Experimental Example 1

MgO pellets were loaded into a MgO deposition chamber, and a MgO layer was deposited on a dielectric layer formed on a substrate. The deposited MgO protective layer had a thickness of approximately 7000 Å. The pressure inside the deposition chamber was set at $1\times10^{-4}$ Pa except during deposition when it was increased to $5.3\times10^{-2}$ Pa. The substrate was maintained at 200±5° C. while supplying oxygen at a rate of 100 sccm. Electron beams were emitted from an electron gun set at a current of 390 mA and a voltage of −15 kV DC to deposit the MgO protection layer. As a result of depositing the MgO protective layer, 200 columnar crystals per μm$^2$ were obtained, and the discharge delay time of the PDP with the MgO protective layer was 265 ns.

Experimental Example 2

A partial pressure ratio of oxygen to hydrogen was set at approximately 6:1 and the other conditions were maintained as set forth in Experimental Example 1. As a result of depositing the MgO protective layer, 400 columnar crystals per μm$^2$ were obtained, and the discharge delay time of the PDP with the MgO protective layer was 284 ns.

Experimental Example 3

A partial pressure ratio of oxygen to hydrogen was set at approximately 30:1 and the other conditions were maintained as set forth in Experimental Example 1. As a result of depositing the MgO protective layer, 1200 columnar crystals per μm$^2$ were obtained, and the discharge delay time of the PDP with the MgO protective layer was 322 ns.

Experimental Example 4

A partial pressure ratio of oxygen to hydrogen was set at approximately 50:1 and the other conditions were maintained as set forth in Experimental Example 1. As a result of depositing the MgO protective layer, 2100 columnar crystals per μm$^2$ were obtained, and the discharge delay time of the PDP with the MgO protective layer was 339 ns.

Experimental Example 5

A partial pressure ratio of oxygen to hydrogen was set at approximately 100:1 and the other conditions were maintained as set forth in Experimental Example 1. As a result of depositing the MgO protective layer, 3400 columnar crystals per μm$^2$ were obtained, and the discharge delay time of the PDP with the MgO protective layer was 345 ns.

Experimental Example 6

A partial pressure ratio of oxygen to hydrogen was set at approximately 150:1 and the other conditions were maintained as set forth in Experimental Example 1. As a result of the MgO protective layer, 5000 columnar crystals per μm$^2$ were obtained, and the discharge delay time of the PDP with the MgO protective layer was 368 ns.

The results of the Experimental Examples 1 to 6 are summarized in Table 1.

TABLE 1

| Experimental Example | Partial pressure ratio of oxygen to hydrogen | Number of columnar crystals per μm$^2$ | Discharge delay time |
|---|---|---|---|
| Experimental Example 1 | 3:1 | 200 | 265 ns |
| Experimental Example 2 | 6:1 | 400 | 284 ns |

TABLE 1-continued

| Experimental Example | Partial pressure ratio of oxygen to hydrogen | Number of columnar crystals per $\mu m^2$ | Discharge delay time |
|---|---|---|---|
| Experimental Example 3 | 30:1 | 1200 | 322 ns |
| Experimental Example 4 | 50:1 | 2100 | 339 ns |
| Experimental Example 5 | 100:1 | 3400 | 345 ns |
| Experimental Example 6 | 150:1 | 5000 | 368 ns |

As shown in Table 1, for Experimental Example 2, the discharge delay time was reduced to less than 300 ns, and the discharge quality was improved. In this case, the density of columnar crystals in the MgO protective layer was about 400 columnar crystals per $\mu m^2$ or less. If the density of columnar crystals is in this range, the address discharge delay during the plasma discharge can be minimized, thereby improving the display quality.

Meanwhile, the thickness of the MgO protective layer obtained in the Experimental Examples 1 and 2 was about 6400 Å, and the refractive index thereof was 1.45-1.74. The (111) planes and the (110) planes were mixed in the MgO protective layer, and improved discharge quality was obtained.

As described above, when the density of columnar crystals of the MgO protective layer is about 400 columnar crystals per $\mu m^2$ or less, the discharge delay time is minimized, thereby improving the discharge quality of the PDP.

Furthermore, if the refractive index of the MgO protective layer is 1.45-1.74, the discharge delay time can be reduced. Also, if the (111) planes and the (110) planes are mixed in the MgO protective layer, the above effects are obtained.

Meanwhile, when the bulk density of the MgO pellets for the protective layer of the PDP is 2.80-2.95 $g/cm^3$, the deposition speed of the MgO layer is increased, thereby enhancing the productivity of the PDP while reducing the splash phenomena.

If the mean crystal grain size of the MgO pellets is 30-70 μm, the productivity of the PDP is further enhanced, and the splash phenomenon is significantly reduced.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display panel comprising:

a first substrate and a second substrate facing each other;

a plurality of first electrodes and a plurality of second electrodes internally formed on the first substrate and the second substrate, respectively;

first and second dielectric layers covering the first electrodes and the second electrodes, respectively; and a MgO protective layer covering at least one of the dielectric layers; wherein the MgO protective layer has 400 or less columnar crystals per $\mu m^2$ and a refractive index ranging from about 1.45 to about 1.74.

2. The plasma display panel of claim 1 wherein the MgO protective layer has (111) planes and (110) planes in a mixed manner.

3. A MgO protective layer for a plasma display panel comprising MgO pellets having a bulk density between 2.80 and 2.95 $g/cm^3$, wherein the MgO protective layer has 400 or less columnar crystals per $\mu m^2$.

4. The MgO protective layer of claim 3 wherein the MgO pellets have a mean crystal grain size between 30 and 70 μm.

* * * * *